US008955293B2

(12) United States Patent
Leighton

(10) Patent No.: US 8,955,293 B2
(45) Date of Patent: Feb. 17, 2015

(54) RECLOSABLE BAG AND ZIPPER THEREFOR

(75) Inventor: Murray Edward Bruce Leighton, Whitley Bay (GB)

(73) Assignee: Illinois Took Works Inc., Glenview, IL (US)

( * ) Notice: Subject to any disclaimer, the term of this patent is extended or adjusted under 35 U.S.C. 154(b) by 40 days.

(21) Appl. No.: 13/491,217

(22) Filed: Jun. 7, 2012

(65) Prior Publication Data

US 2012/0245009 A1 Sep. 27, 2012

Related U.S. Application Data

(63) Continuation of application No. 11/659,746, filed as application No. PCT/GB2005/003306 on Aug. 24, 2005.

(30) Foreign Application Priority Data

Aug. 28, 2004 (GB) ..... 0419218.3

(51) Int. Cl.
*B65B 61/18* (2006.01)
*B31B 1/64* (2006.01)
*B65D 33/25* (2006.01)

(52) U.S. Cl.
CPC ..... *B65D 33/2591* (2013.01); *Y10S 493/927* (2013.01)
USPC ..... 53/412; 493/212; 493/213; 493/927

(58) Field of Classification Search
CPC ..... B65B 9/02; B65B 51/10; B65B 51/146; B31B 19/90
USPC ..... 493/212, 213, 927; 53/412
See application file for complete search history.

(56) References Cited

U.S. PATENT DOCUMENTS

| | | | | |
|---|---|---|---|---|
| 4,601,694 | A * | 7/1986 | Ausnit | 493/381 |
| 5,456,928 | A | 10/1995 | Hustad et al. | |
| 5,653,090 | A * | 8/1997 | Weiss et al. | 53/425 |
| 5,673,534 | A * | 10/1997 | Fowler | 53/133.4 |
| 6,183,134 | B1 | 2/2001 | Malin | |
| 6,605,026 | B1 | 8/2003 | Tomic | |
| 6,662,843 | B1 * | 12/2003 | Johnson | 156/519 |
| 6,810,642 | B2 * | 11/2004 | Cortigiano, Sr. | 53/412 |
| 6,820,393 | B2 * | 11/2004 | Kinigakis et al. | 53/412 |
| 6,863,646 | B2 * | 3/2005 | Kinigakis et al. | 493/213 |
| 6,884,208 | B2 * | 4/2005 | Haws | 493/213 |
| 6,895,725 | B2 * | 5/2005 | Cortigiano, Sr. | 53/133.4 |

(Continued)

FOREIGN PATENT DOCUMENTS

| | | |
|---|---|---|
| EP | 1 375 370 A1 | 1/2004 |
| EP | 1457428 A1 | 9/2004 |

(Continued)

*Primary Examiner* — Gloria R Weeks
(74) *Attorney, Agent, or Firm* — McCarter & English, LLP

(57) ABSTRACT

A reclosable zipper fastener has a slider 40 and first and second profiles 24, 26. Each profile has a body 32, 34 and a flange 28, 30 which has three zones which are, successively and in the direction away from the body, an anti-seal zone 42, 43, a line-of-weakness formation zone 44, 45 and a sealing zone 46, 47. The zipper can be used in a bag in which it is secured internally of a top seal 20, the line-of-weakness zones 44, 45 forming lines along which a top portion of the bag can be removed to open the bag. The bag can then be sealed using the zipper. A tamper-evident feature is thus provided.

12 Claims, 2 Drawing Sheets

(56) References Cited

U.S. PATENT DOCUMENTS

| | | | | |
|---|---|---|---|---|
| 6,993,886 | B2 * | 2/2006 | Johnson | 53/412 |
| 7,059,099 | B2 * | 6/2006 | Ausnit | 53/133.4 |
| 7,094,455 | B2 * | 8/2006 | Johnson et al. | 428/40.1 |
| 7,096,646 | B2 * | 8/2006 | Schneider et al. | 53/412 |
| 7,101,079 | B2 | 9/2006 | Strand et al. | |
| 7,165,887 | B2 | 1/2007 | Strand et al. | |
| 7,185,475 | B2 * | 3/2007 | Ausnit | 53/412 |
| 7,322,920 | B2 * | 1/2008 | Johnson | 493/213 |
| 7,351,188 | B2 * | 4/2008 | Schaller et al. | 493/213 |
| 7,364,362 | B2 * | 4/2008 | Schneider et al. | 383/61.2 |
| 7,419,301 | B2 * | 9/2008 | Schneider et al. | 383/209 |
| 7,465,265 | B2 * | 12/2008 | Hinesley | 493/231 |
| 8,105,225 | B2 * | 1/2012 | Ausnit | 493/213 |
| 8,397,474 | B2 * | 3/2013 | McMahon et al. | 53/412 |
| 2001/0017950 | A1 | 8/2001 | Strand et al. | |
| 2003/0179955 | A1 | 9/2003 | Rehwinkel | |
| 2004/0058039 | A1 | 3/2004 | Strand et al. | |
| 2004/0179755 | A1 | 9/2004 | Cornelisse | |
| 2005/0152622 | A1 | 7/2005 | Woody et al. | |
| 2005/0281490 | A1 | 12/2005 | Schneider et al. | |

FOREIGN PATENT DOCUMENTS

| | | | |
|---|---|---|---|
| EP | 1 375 370 | B1 | 8/2006 |
| JP | 11-157553 | A | 6/1999 |
| WO | 03/066459 | A2 | 8/2003 |
| WO | 03097341 | A1 | 11/2003 |
| WO | 2005070661 | A1 | 8/2005 |
| WO | 2005092139 | A1 | 10/2005 |

* cited by examiner

RECLOSABLE BAG AND ZIPPER THEREFOR

This application is a continuation of application Ser. No. 11/659,746, filed on Aug. 20, 2007, the contents of which are incorporated in their entirety.

BACKGROUND OF THE INVENTION

The present invention relates to reclosable bags, and other containers, and to zippers for use in making the bags or other containers.

"Zippers" are a particular type of reclosable fastener which consist of first and second lengths of material, usually plastics, which are shaped to engage with each other along their lengths and can be released from engagement and repeatedly re-engaged and re-released. The zipper can thus form a reclosable fastener for a container, for example a plastics bag. The individual lengths of material making up the zipper are known as "profiles". The profiles can be engaged by pressing them together and released by pulling them apart. Alternatively, the zipper may be fitted with a slider which is moveable along the zipper to cause engagement and release the profiles upon movement of the slider in first and second opposite directions. These zippers are known as "slider zippers". The present invention is applicable to slider and non-slider zippers.

A particular concern with the bags and other containers to which this invention relates is to provide a "tamper evident" feature. This is a feature which makes it evident that the container has been opened subsequently to the putting into place of the tamper-evident feature.

BRIEF SUMMARY OF THE INVENTION

The object of the present invention is to provide a container with a tamper-evident feature and a zipper which can be used in the making of such a container.

The present invention provides a zipper for use in making a reclosable container, the zipper comprising first and second profiles each having a portion extending longitudinally of the profile and being shaped for releasable engagement with the corresponding portion of the other profile, at least one of the profiles having a longitudinally extending flange portion which comprises successively from the portion for releasable engagement:

a first, antiseal zone which does not seal to a substrate upon application of a sealing means;

a second, line-of-weakness-forming zone which forms in a said substrate a line of weakness extending in the longitudinal direction of the zone, upon application of a sealing means; and a third, seal zone which forms a longitudinally-extending seal with the substrate upon application of a sealing means.

The sealing means to be used can be any which is convenient and suited to the properties of the first, second and third zones. Examples are heat, pressure and ultrasonic waves, and combinations of one or more thereof.

Preferably, both profiles have longitudinally-extending flange portions. If so, both flange portions preferably extend laterally in the same direction from the engagement portions when the portions are in engagement with each other.

When both profiles have flange portions, both flange portions preferably have first, second and third zones as defined above.

In any zipper according to the invention, second zone(s) is/are preferably formed as:

a low-seal zone having a degree of sealability between that of the first zone and that of the third zone;

a line of serrations or perforations; or a tear strip, tear tape or length of line, for example of nylon.

When a low-seal zone is provided, it can be produced by a suitable choice of material of the flange, coating material applied to the flange or surface treatment of the flange or coating.

The invention also provides a reclosable container having an opening and a zipper as referred to above, the first and second profiles being attached to respective wall portions of the container, by way of a seal between the wall portion and the third zone of the flange portion of the profile, the second zone forming a line-of-weakness in the respective wall portion which can be severed along the line of weakness to allow access to the zipper and thereby opening of the container. A tamper-evident feature is thus provided.

In such a container, the zipper preferably has two flanges, both of which have first, second and third zones as stated and the attachment of the profiles to the respective container walls is by way of seals between the respective wall portions and the third zones of the flange portions, the second zones of the flanges portions forming respective lines of weakness which can be severed along the lines of weakness to allow complete removal of a portion of the container to allow the said access to the zipper.

Advantageously and regardless of the number of zipper flanges, the container is a bag of flexible sheet material, the zipper being attached to respective interior surfaces of opposed wall portions of the bag, the wall portions being sealed to each other outwardly of the zipper, so that the bag can be opened by severing along the line-of-weakness formed in the respective wall portion and can be subsequently closed by engagement of the zipper profiles.

When the zipper has first and second flanges, the zipper is preferably attached to respective interior surfaces of opposed wall portions of the bag, the wall portions being sealed to each other outwardly of the zipper, so that the bag can be opened by severing along both lines-of-weakness formed in the respective wall portions, thus allowing removal of a portion of the bag comprising the sealed wall portions and subsequent closure of the bag by engagement of the zipper profiles.

An embodiment of the invention will now be described by way of example with reference to the drawings of this specification, in which:

BRIEF DESCRIPTION OF THE SEVERAL VIEWS OF THE DRAWING(S)

FIG. 1 is a somewhat schematic perspective view of a plastics bag;

FIG. 2 corresponds to FIG. 1 but shows a top portion of the bag separated from the remainder of the bag;

DETAILED DESCRIPTION OF THE INVENTION

Figure 1:
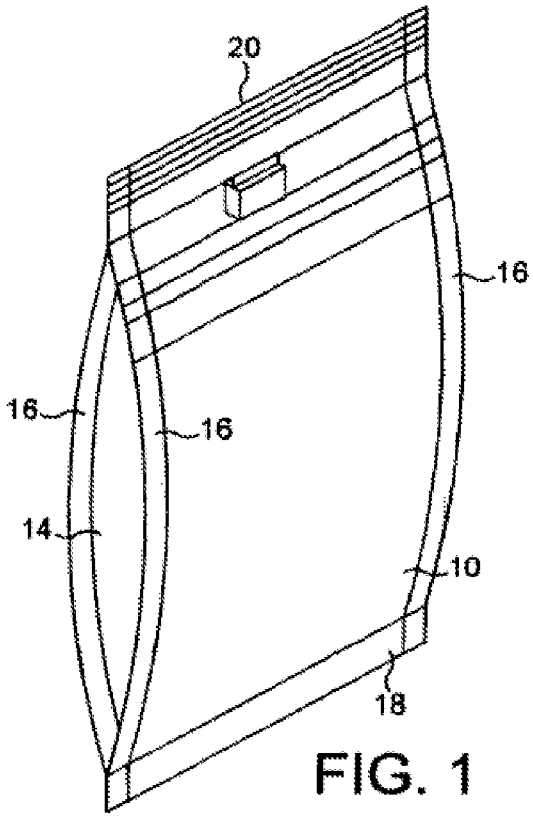
Figure 2:
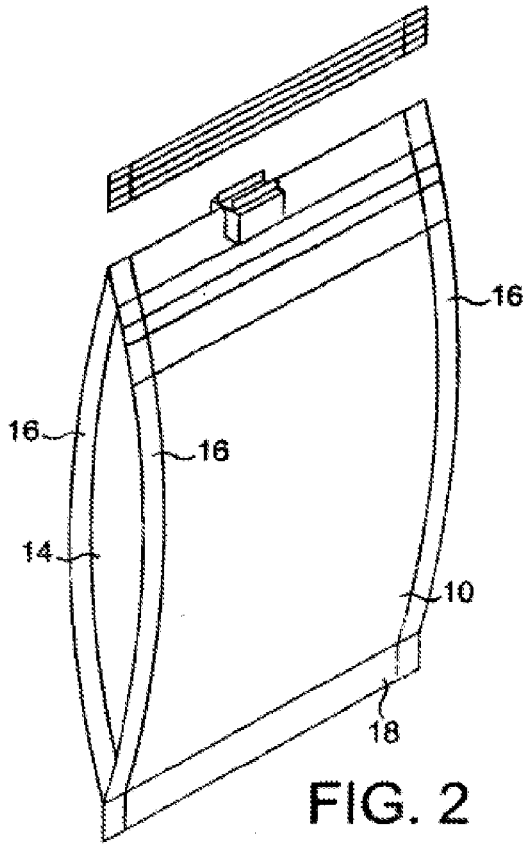
Figure 3:
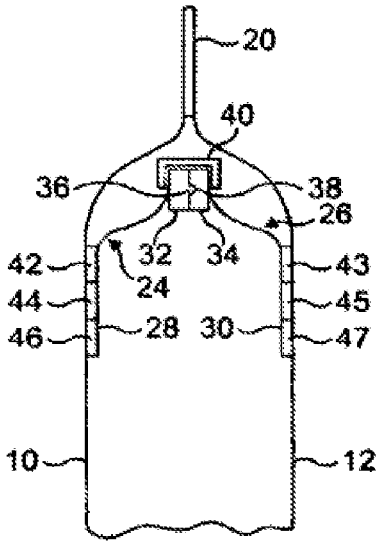
FIG. 3 is a vertical sectional view on an enlarged scale through the upper part of the bag of FIG. 1.

FIGS. 1 to 3 show a bag which is made from a suitable plastics film material such as polyethylene or a laminated plastics film material.

The bag has a rectangular front panel 10, a rectangular rear panel 12 and two gusset-forming side panels 14. The front and rear panels 10, 12 are joined to the side panels 14 by respective side welds 16 formed by the application of heat and pressure to the plastics film material. The bag may be constructed from individual panels 10, 12, 14 joined by the welds 16 which are then seams or, as is preferred, folded from a single piece of film material. In the latter case, the bag may have a longitudinal back seam where the longitudinal edges of the film overlap and are heat sealed to each other. When present, the back seam is preferably located centrally of the rear panel 12. In an alternative construction, also formed from a single piece of material, longitudinal edges of the film are joined to each other at one of the side welds 16. When the bag is constructed from more than one piece of film, the pieces of the film are preferably joined to one another at the side welds 16. In all the constructions mentioned, these side welds 16 which do not form a join between separate pieces of film material are formed by welding the folded film to itself each side of the respective fold line.

A transverse bottom weld 18 is formed by the application of heat and, pressure to the film material. The bottom weld 18 joins the front, rear and side panels 10, 12, 14 together to close the bottom of the bag.

The top of the bag is closed by a transverse top weld 20 which is also formed by the application of heat and pressure to the film material. The top weld 20 also joins the front, rear and side panels 10, 12, 14 together to close the top of the bag.

A length of zipper 22 (which is shown in more detail in FIGS. 4 and 5 and described further below) is attached to the inner surfaces of the front and back panels 10, 12 of the bag adjacent the upper end of the bag and inwardly of the top weld 20.

The zipper 22 consists of first and second profiles 24, 26, each of which comprises a flange portion 28, 30 respectively and a body portion 32, 34 respectively. The first body portion 32 is formed with a male formation 36 which extends the length of the body portion and is shaped to engage with a female formation 38 which extends the length of the second body portion 34. A slider 40 is mounted on the zipper profiles 24 and is movable along the length of the zipper in order to bring the male and female formations 36,38 into and out of engagement with each other upon movement of the slider in respective first and second, opposite directions along the length of the zipper. The construction of the slider 40 and its interaction with the zipper profiles 24, 26 is conventional and need not be described further here, it being understood that the slider 40 and the profiles 36, 38 are shown only schematically in the figures.

Each flange portion 28, 30 of the zipper has three longitudinally extending zones. The zones of the flange portion 28 of the first profile 24 will be described first. A first zone 42 closest to the male formation 36 of the profile is an anti-seal zone which is not sealed to the inner surface of the front panel 10 of the bag. This lack of sealing is achieved by coating the flange 28 with a material such as nitrocellulose or by surface treatment, for example corona discharge treatment to a surface tension of, for example, 38 dynes/cm. It is thus ensured that the anti-seal zone 42 does not form a seal with the material of the front panel when subjected to heat and pressure.

A second zone 44 next outwardly from the male formation 36 is a zone which forms a line of weakness in the material of the bag front panel 10, when heat and pressure are applied. In this embodiment, the line of weakness is formed as a low seal area which, upon the application of heat and pressure, causes a physical change in the material of the bag which results in a line of weakness being formed. A suitable material for achieving this is a coating of an olefinic copolymer which can have substantially better sealing properties than ethylene vinyl acetate polymers, or an ionomer resin sold under the name of SURLYN® and available from Dupont.

A third zone 46 of the flange 28 furthest from the male formation 36 is a sealing zone which, under application of heat and pressure, forms a heat seal with the inner surface of the material of the front panel 10 of the bag.

The flange portion 30 of the second zipper profile 26 is formed with three zones 43, 45, 47 which correspond exactly to the zones 42, 44, 46 of the flange portion 28 of the first zipper profile 24, the profile thus being attached to the inner surface of the rear wall 14 of the bag by a heat seal extending the length of the third zone 47.

The zipper 22 may be applied to a web of the plastics film material from which the bag is eventually made by use of what is known as "cross-web technology". This means that individual lengths of zipper are applied to the web to extend transversely, usually perpendicularly, to the longitudinal diversion of the web and spaced at longitudinal intervals. Our international patent application WO-A-03/097341 describes and claims a method of and apparatus for applying the zipper to the web whilst the web is moving; our co-pending UK patent application 0401500.4 describes and claims further methods and apparatus, also for applying the zipper to the moving web.

The slider 40 may be mounted on the zipper profiles prior to their being cut to length and applied to the web. Our co-pending UK patent application 0406626.3 describes and claims an apparatus for and method of achieving this. Slider applicators for use in such apparatus and methods are available from Supreme Plastics Limited of Supreme House, 300 Regents Park Road, London, N3 2TL, UK.

The bag shown in the drawings may be formed and filled in a single operation performed on a form-fill-seal machine which may be of the vertically or the horizontally operating type. Examples of such machines and their use in conjunction with cross-web technology are to be found in international patent application WO-A-03/097341 and UK patent applications 0401500.4 and 0406626.3 referred to above. Such methods and apparatus when used to carry out methods in accordance with present invention involve the attachment of one of the flange portions 28, 30 or a pre-cut length of zipper centrally to a surface of a web of material from which the package is to be formed (the surface eventually providing an inner surface of one face of the bag), the subsequent forming of the web material around the forming shoulder of a vertically operating machine or the forming box of a horizontally operating machine, the formation of back, top and bottom seals as appropriate, together with the formation of any necessary side seals or welds, and the attachment of the other flange portion to the surface of the web which forms the inner surface of the opposite face of the bag. These formation and attachment steps can take place by the application of, for example, heat, pressure, ultrasonic waves, or otherwise, alone or in combination. The male and female formations 36, 38 are least partially joined throughout this process and, if necessary, are brought into full engagement when the second flange portion becomes attached to the web by heat and/or pressure and/or other means, including ultrasonic energy.

In modified apparatus and methods, the form-fill-seal machines are replaced by respective bag-making machines to produce empty bags which can be filled (through their open bottoms) and sealed subsequently. Such bags are known as "pre-made bags".

By way of further modification, both the form-fill-seal machines and the bag-making machines are omitted and the web with zipper attached at spaced intervals is wound onto a reel for subsequent use either in a vertical or horizontal form-fill-seal machine or in a bag-making machine as mentioned above. This process is of the type known as a "reel-to-reel" process.

In order to gain access to the contents of the bag after filling, the material of the front and rear panels 10, 12 of the bag is severed along its respective lines of weakness defined by the second zones 44, 45 of the respective flanges 28, 30 of the zipper 22. A top portion of the bag consisting of the top weld 20 and the upper parts of the front and rear panels 10, 12 is then removed from the bag, as shown in FIG. 1, in order to gain access to the slider 40 which can then be manipulated so as to separate the zipper profiles and allow access to the contents of the bag. It will be clear that, prior to severing of the upper portion of the bag along the lines of weakness defined by the second zones of the zipper flanges, the zipper slider will be inaccessible and therefore protected from tampering. Equally, after severing of the film along the lines of weakness, the opening of the bag will be immediately apparent and an effective tamper evident feature will have been provided.

Figure 4:
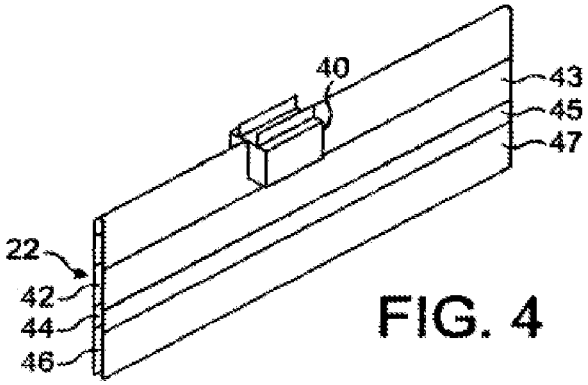
FIG. 4 is a perspective view of a length of zipper used in making the bag of FIGS. 1 and 2.
Figure 5:
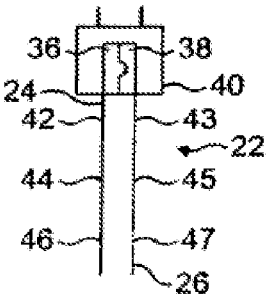
FIG. 5 is a transverse sectional view of the zipper of FIG. 4.

FIGS. 4 and 5 of the drawings show the zipper 22 as described above having a slider 40, respective body portions 32, 34 and flanges 24, 26.

The invention claimed is:

1. A method of making a reclosable container with a zipper, comprising the steps of:

providing a zipper which comprises first and second profiles each having a portion extending longitudinally of the profile and being shaped for releasable engagement with the corresponding portion of the other profile, at least one of the profiles having a longitudinally extending flange portion;

providing a substrate;

applying a sealing means thereby sealing the longitudinally extending flange portion to the substrate, wherein the flange portion includes:

a first antiseal zone which does not seal to a substrate during the step of applying the sealing means;

a second line-of-weakness-forming zone which forms in said substrate, by said step of applying a sealing means, a line of weakness extending in the longitudinal direction of the zone; and a third seal zone which forms a longitudinally-extending seal with the substrate during the step of applying the sealing means, formed simultaneously with formation of said second, line-of-weakness forming zone during the step of applying the sealing means; and wherein the step of applying the sealing means includes the steps of applying heat and pressure and is applied to the first, second and third zones.

2. The method according to claim 1, in which both profiles have longitudinally-extending flange portions.

3. The method according to claim 2, in which both flange portions extend laterally in the same direction from the engagement portions when the portions are in engagement with each other.

4. The method according to claim 2, in which both flange portions have said first, second and third zones.

5. The method according to claim 1, in which the second zone is formed as:

a low-seal zone having a degree of sealability between that of the first zone and that of the third zone;

a line of serrations; or a tear strip.

6. The method according to claim 5, in which the container is a bag of flexible sheet material which forms the substrate, the zipper being attached to respective interior surfaces of opposed wall portions of the bag, the wall portions being sealed to each other outwardly of the zipper, so that the bag can be opened by severing along both lines-of-weakness formed in the respective wall portions, thus allowing removal of a portion of the bag comprising the sealed wall portions and subsequent closure of the bag by engagement of the zipper profiles.

7. A method of making a reclosable container with a zipper, comprising the steps of:

providing a zipper which comprises first and second profiles each having a portion extending longitudinally of the profile and being shaped for releasable engagement with the corresponding portion of the other profile, at least one of the profiles having a longitudinally extending flange portion;

providing a substrate;

applying a sealing means thereby sealing the longitudinally extending flange portion to the substrate, wherein the flange portion includes:

a line-of-weakness-forming zone which forms in said substrate, by said step of applying a sealing means, a line of weakness extending in the longitudinal direction of the zone; and a seal zone which forms a longitudinally-extending seal with the substrate during the step of applying the sealing means, formed simultaneously with formation of said line-of-weakness forming zone during the step of applying the sealing means; and wherein the step of applying the sealing means includes the steps of applying heat and pressure and is applied to the line-of-weakness forming zone and the seal zone.

8. The method according to claim 7, in which both profiles have longitudinally-extending flange portions.

9. The method according to claim 8, in which both flange portions extend laterally in the same direction from the engagement portions when the portions are in engagement with each other.

10. The method according to claim 8, in which both flange portions have said seal zone and said line-of-weakness-forming zone.

11. The method according to claim 7, in which the line-of-weakness-forming zone is formed as:

a low-seal zone having a degree of sealability less than that of the seal zone;

a line of serrations; or a tear strip.

12. The method according to claim 11, in which the container is a bag of flexible sheet material which forms the substrate, the zipper being attached to respective interior surfaces of opposed wall portions of the bag, the wall portions being sealed to each other outwardly of the zipper, so that the bag can be opened by severing along both lines-of-weakness formed in the respective wall portions, thus allowing removal of a portion of the bag comprising the sealed wall portions and subsequent closure of the bag by engagement of the zipper profiles.

* * * * *